US010413799B2

(12) United States Patent
Jones

(10) Patent No.: US 10,413,799 B2
(45) **Date of Patent: *Sep. 17, 2019**

(54) KIT FOR BUILDING ACCELERATED WATER REMOVAL SAND BUNKERS FOR MULTI-HOLE GOLFING FACILITY

(71) Applicant: Casey Jones, Humble, TX (US)

(72) Inventor: Casey Jones, Humble, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/783,493

(22) Filed: Oct. 13, 2017

(65) Prior Publication Data

US 2018/0280778 A1 Oct. 4, 2018

Related U.S. Application Data

(63) Continuation of application No. 15/466,596, filed on Mar. 22, 2017, now Pat. No. 9,795,854.

(60) Provisional application No. 62/475,077, filed on Mar. 22, 2017.

(51) Int. Cl.

| | |
|---|---|
| ***A63B 57/00*** | (2015.01) |
| ***A63B 69/36*** | (2006.01) |
| ***A63B 57/10*** | (2015.01) |
| ***A63B 57/40*** | (2015.01) |
| ***A63B 57/30*** | (2015.01) |
| ***E02B 11/00*** | (2006.01) |
| ***E01C 13/02*** | (2006.01) |

(52) U.S. Cl.

CPC ..... *A63B 69/3691* (2013.01); *A63B 57/10* (2015.10); *A63B 57/357* (2015.10); *A63B 57/40* (2015.10); *E01C 13/02* (2013.01); *E02B 11/00* (2013.01)

(58) Field of Classification Search

CPC ..... E01C 13/02; E01C 13/083; E02B 11/00; A63B 69/3691

USPC ..... 473/168, 169, 173; 405/302.4–302.7

See application file for complete search history.

(56) References Cited

U.S. PATENT DOCUMENTS

| | | | | |
|---|---|---|---|---|
| 4,960,345 A * | 10/1990 | Hurley | E01C 13/02 405/258.1 |
| 5,147,156 A * | 9/1992 | Guettler | B65G 53/06 406/108 |
| 7,207,747 B1 * | 4/2007 | England | E01C 13/02 210/170.01 |
| 7,399,145 B2 * | 7/2008 | Clark | A63B 57/00 405/302.7 |
| 8,062,143 B1 * | 11/2011 | Meersman | E01C 13/02 405/302.4 |

(Continued)

*Primary Examiner* — Mark S Graham

(74) *Attorney, Agent, or Firm* — Nolte Intellectual Property Law Group

(57) ABSTRACT

A kit for building sand bunkers for accelerated water removal low maintenance multi-hole golfing facility. The sand bunkers are water permeable and water shuttling. Each kit creates a plurality of sand bunker each having a continuous bunker edge, a drain assembly, a synthetic tufted surface, a continuous integral edge overlapping polymer mesh, a non-woven dual smooth surfaced geo-textile, and a sand layer. Once built with the kit, the water in the sand bunker flows from the continuous bunker edge over the synthetic tufted surface, through the non-woven dual smooth surfaced geo-textile to the drain assembly while preventing the drain assembly from clogging, thereby maintaining an unclogged drain assembly for the water permeable and water shuttling sand bunker.

21 Claims, 8 Drawing Sheets

(56) References Cited

U.S. PATENT DOCUMENTS

| | | | | |
|---|---|---|---|---|
| 8,529,159 | B2 * | 9/2013 | Lemons | A63B 69/3691 405/302.6 |
| 8,845,443 | B1 * | 9/2014 | Weaver | E01C 13/065 405/302.6 |
| 9,566,775 | B2 * | 2/2017 | Li | B09B 1/00 |
| 9,604,110 | B1 * | 3/2017 | Skawski, Jr. | A63B 57/50 |
| 9,795,854 | B1 * | 10/2017 | Jones | A63B 69/3691 |
| 2003/0082004 | A1 * | 5/2003 | Wilkerson | E01C 13/02 405/43 |
| 2004/0156679 | A1 * | 8/2004 | Jenkins | C09K 17/52 404/76 |
| 2006/0051161 | A1 * | 3/2006 | Benson | E01C 13/02 405/43 |
| 2006/0193703 | A1 * | 8/2006 | Carlson | E02D 17/205 405/302.4 |
| 2007/0237583 | A1 * | 10/2007 | Corwon | E01C 13/02 405/37 |
| 2007/0278142 | A1 * | 12/2007 | Clark | E01C 13/02 210/153 |
| 2011/0200401 | A1 * | 8/2011 | Lemons | A63B 69/3691 405/302.4 |
| 2013/0116060 | A1 * | 5/2013 | Allen | A63B 69/3661 473/173 |
| 2013/0184090 | A1 * | 7/2013 | Sternberg | E01C 7/142 473/173 |

* cited by examiner

KIT FOR BUILDING ACCELERATED WATER REMOVAL SAND BUNKERS FOR MULTI-HOLE GOLFING FACILITY

CROSS-REFERENCE TO RELATED APPLICATIONS

The present application is a continuation of U.S. patent Ser. No. 15/466,596 filed on Mar. 22, 2017 for "Accelerated Water Removal Low Maintenance Multi-Hole Golfing Facility," and which claims priority to U.S. Provisional Patent Application Ser. No. 62/475,077 filed Mar. 22, 2017, for "Kit for Building Accelerated Water Removal Sand Bunkers for Multi-Hole Golfing Facility." These references are hereby incorporated in their entirety.

FIELD

The present embodiments generally relate to a kit for building sand bunker that enable an accelerated water removal at a multi-hole golfing facility.

BACKGROUND

A need exists for a kit to build sand bunkers of a golf course to hold and maintain the established bunker edge.

A further need exists for sand bunkers that reduce contamination and clogging up of the drainage system with native soils, from around and under a golf facility.

The present embodiments meet these needs.

BRIEF DESCRIPTION OF THE DRAWINGS

The detailed description will be better understood in conjunction with the accompanying drawings as follows.

Figure 1:
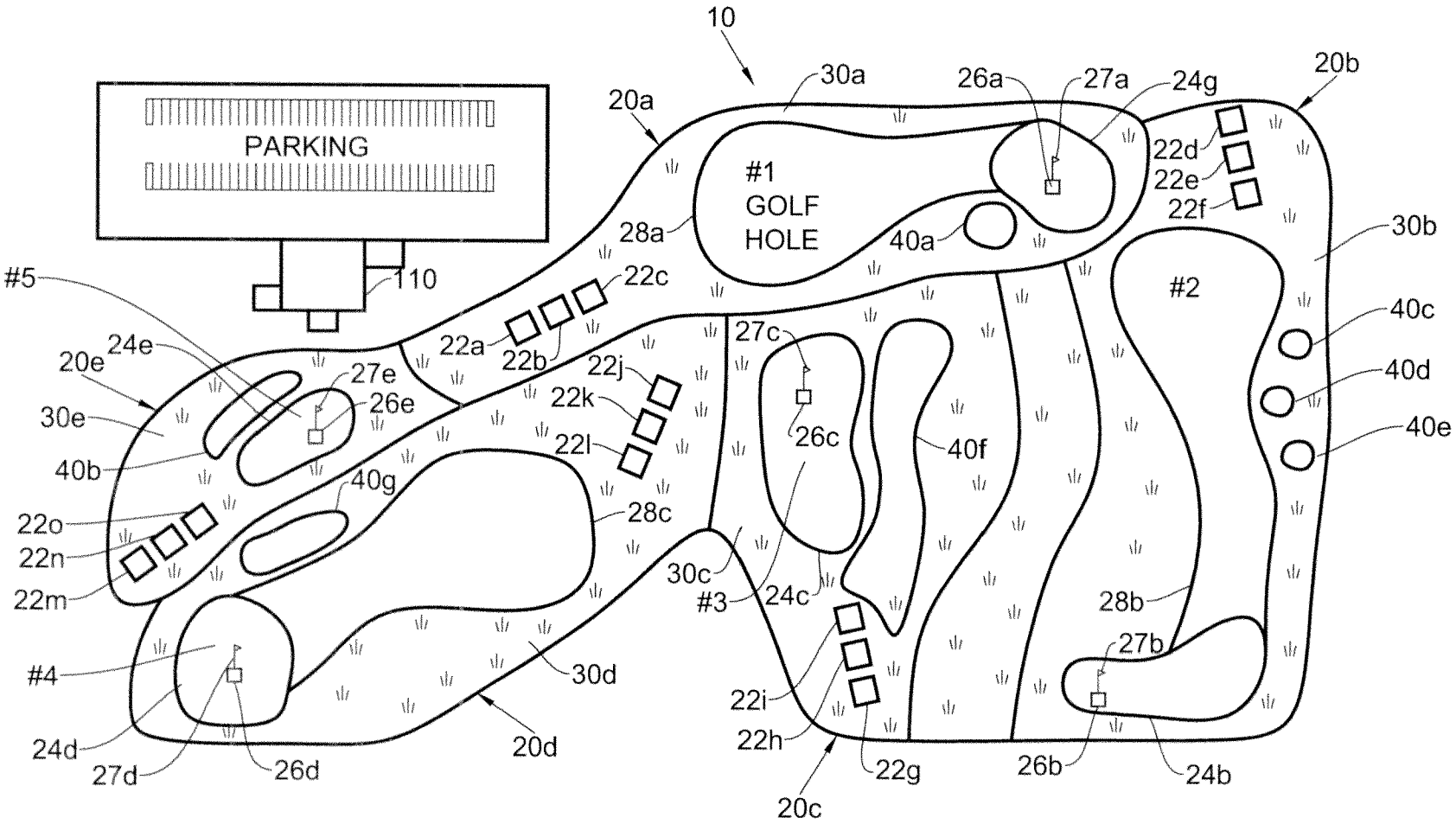
FIG. 1 depicts an accelerated water removal low maintenance multi-hole golfing facility with sand bunkers built with the kit according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The invention relates to a kit for building sand bunkers for accelerated water removal low maintenance multi-hole golfing facility.

The sand bunkers are water permeable and water shuttling.

Each kit creates a plurality of sand bunker each having a continuous bunker edge, a drain assembly, a synthetic tufted surface, a continuous integral edge overlapping polymer mesh, a non-woven dual smooth surfaced geo-textile, and a sand layer.

Once built with the kit, the water in the sand bunker flows from the continuous bunker edge over the synthetic tufted surface, through the non-woven dual smooth surfaced geo-textile to the drain assembly while preventing the drain assembly from clogging, thereby maintaining an unclogged drain assembly for the water permeable and water shuttling sand bunker.

The embodiments allow the water permeable and water shuttling sand bunker to hold sand when the water permeable and water shuttling sand bunker walls slope over 30 degrees, such as at 35 degrees from the ground surface.

In the embodiments, the water permeable and water shuttling sand bunker of the golf course holds and maintains an established bunker edge.

The embodiments maintain a United States Golf Association (USGA) type gravel drainage system, which has a defined flow rate to maintain all sand bunkers consistently to specifications determined by the USGA.

The embodiments reduce rainfall washouts at a golf facility.

The embodiments allow the synthetic tufted surface to hold sand in place within the sand bunker.

The kit enables the multi-hole golf course facility to have reduced maintenance costs on its golf holes.

The embodiments prevent native soil from around and under a golf course, from contaminating a sand bunker of a golf course.

In embodiments, the structure of the sand bunker made with the kit prevents worms and other animals from burrowing into the sand bunkers or sod adjacent to the sand bunkers, reducing maintenance. For example, gophers, deer, pigs, and dogs are prevented from digging up the sand bunker and adjacent sod, with the special structure.

The embodiments of sand bunkers built with the kit reduce contamination and clogging up of the drainage system with native soils, from around and under a golf facility.

The kit can be used at a multi-hole golfing facility with a plurality of golf holes.

Each golf hole has a tee for striking a golf ball, a green comprising sod for each golf hole, a cup for holding a pin with a flag positioned in each green, each cup positioned apart from a tee providing a target, a fairway sod comprising sod between the tees and the cup; and a rough sod comprising sod, surrounding each fairway sod.

The kit enables creation of a plurality of water permeable and water shuttling sand bunkers. Each water permeable and water shuttling sand bunker is positioned adjacent to a green, fairway sod, or a rough sod Each water permeable and water shuttling sand bunker has a continuous bunker edge performing as a perimeter of the water shuttling sand bunker.

The water permeable and water shuttling sand bunker has a drain assembly positioned at a location to receive water falling on sand within the continuous bunker edge.

The drain assembly has a drainage trench, a drainage pipe that fills between 30% and 40% of the drainage trench, and an aggregate material surrounding the drainage pipe.

The water permeable and water shuttling sand bunker has a synthetic tufted surface positioned to extend from the continuous bunker edge to the drain assembly without covering the drain assembly.

In embodiments, the water permeable and water shuttling sand bunker has a continuous integral edge overlapping polymer mesh with a sod side mounted under the sod of a green, fairway sod or rough sod, a middle section mounted over the continuous bunker edge, and a sand side mounted under the synthetic tufted surface.

In embodiments, the continuous polymer mesh has holes only large enough to accommodate grass root penetration from sod and creating an anchor.

The water permeable and water shuttling sand bunker built with the kit have a non-woven dual smooth surfaced geo-textile encapsulating the drain assembly, positioned under from 5% to 30% of the synthetic tufted surface.

The non-woven dual smooth surfaced geo-textile is configured for allowing water flow and water filtration while simultaneously excluding sand from entering the drain assembly.

The water permeable and water shuttling sand bunker built with the kit has a sand layer sufficiently thick enabling a golfer to stand on the sand while sufficiently porous to allow water penetration, the sand layer comprising less than 2% fines, disposed over the plurality of segmented synthetic tufted surfaces within the continuous bunker edge; and The sand bunkers built with the kit enable water to flow from the continuous bunker edge over the synthetic tufted surface, through the non-woven dual smooth surfaced geo-textile to the drain assembly preventing the drain assembly from clogging, thereby maintaining an unclogged drain assembly for the water shuttling sand bunker.

The present invention possesses the advantage of being extremely user-friendly, able to be installed easily without special training.

Installation of the kit to create a sand bunker is easy and fast and can form from 4000 to 5000 square feet in a single day.

The kit creates sand bunkers that are easily repairable, and once the sand is removed from the sand bunker, the polymer mesh and the geo-textile fabric can be removed within fifteen to 30 minutes, for cleaning or replacement.

The kit enables creation of a warning system for maintenance crews to see when low sand levels are occurring in sand bunkers to perform preventive maintenance before damage to the sand bunkers occurs.

The kit can be used to create green space and provides more oxygen to the atmosphere and conversion of carbon dioxides, thereby saving the environment.

The following terms are used herein:

The term "accelerated" refers to an improved flow rate of water over the synthetic tufted surface in a water permeable water shuttling sand bunker that is between 10% and 15% quicker in feet per second than conventional drainage system.

The term "adhesive" as used herein refers to a material that bonds the tufted strips together and to the non-woven dual smooth surfaced geo-textile and overlapping polymer mesh The term "aggregate material" refers to particles with diameters ranging from $1/16^{th}$ inch to $3/8^{th}$ inch. The particles can be random sized, typically angular to allow maximum fluid flow.

The term "contamination" refers to introduction of at least 5% by weight based on the total amount of sand in the sand bunker of non-sand material into a sand bunker which term includes, soil, sticks, plastic bags, water bottles, pencils, paper, rocks, The term "continuous bunker edge" refers to a continuous perimeter of the water permeable and water shuttling sand bunker which can have various random shapes, such as ellipsoid shapes, circular shapes, dog bone shapes, kidney shapes, shapes of cartoon characters, shapes of letters, shapes of other identical animal shapes, such as a hog or a swan.

The term "cup" is the receptacle about 6 inches in diameter that a golf ball is putted into to determine a final score for the golfer for the golf hole.

The term "drain assembly" refers to an assembly for deliberate and controlled removal of water surface runoff and subsurface water runoff. The drain assembly provides a healthy environment for greens, improves course playability, allows timely maintenance and thus yields increased golf course revenues. In embodiments, the drain assembly specifically includes a drainage trench, a drainage pipe, and aggregate material surrounding the drainage pipe.

The term "drainage pipe" refers to a perforated pipe, which can be tubular, including a square tubular for transferring water out of the drain assembly. In embodiments, the drainage pipe fills from 30% to 40% of the drainage trench. The drainage pipe in embodiments can be formed from rigid plastic, or shape holding semi-rigid, flexible filter fabric made from polypropylene, or polyethylene filter fabric such as a US 90 NW slit available from US Fabrics of Ohio. In embodiments, the filter fabric can contain a plurality of slits allowing water transfer without particle transfer.

The term "drainage trench" is either a dug hole in earth in the form of a linear conduit, or a formed conduit in the earth into which the drainage pipe is installed longitudinally. In embodiments, the drainage trench has a width from 4 inches to 12 inches. The height of the drainage trench can range from 10 inches to 16 inches. The length of the drainage trench is slightly shorter than a longitudinal axis of the water permeable and water shuttling sand bunker while protruding from the water permeable and water shuttling sand bunker providing an exit point for the water flowing from the drainage pipe contained in the drainage trench. In embodiments, the drainage trench by volume holds the aggregate material and drainage pipe in a ratio of from 60:40 to 70:30 of aggregate:drainage pipe.

The term "fairway sod" refers to the part of the golf course where the grass is cut greater than inch but less than/inch between the tee and the green containing the cup, exclusive of the rough sod, trees, and hazards. A fairway sod can be formed from sod.

The term "fasteners" refers a galvanized steel 6 inch u shaped staple, or similar device to hole the overlapping polymer mesh to another substrate, such as wood when the multi-hole golfing facility is located on moveable surface, such as a barge.

The term "golf hole" refer to the combination of elements that enable a golfer to hit a ball at one end towards a target with a cup and end pin according to the rules of the United States Golfing Association in effect as of March 2017 and the Royal and Ancient Golf Club of St. Andrews in effect as of March 2017.

The term "green" refers to a surface over which a golf ball will roll that is located near the pin. A green is made up of sod surface. The green, unlike rough sod, has short, hybrid grass or synthetic grass that extends about ¼ inch from the surface of the sod.

The term "low maintenance" refers to sand bunkers which require both (i) from 40% to 80% maintenance repair time by maintenance crews (including greens keepers) and (ii) from 10% to 20% contamination of sand by native soil or other material while providing a real time indicator to golf course maintenance of the need to replenish sand levels.

The term "multi-hole golfing facility" refers to at least one of a 9 hole, 18 hole, 27 hole, 36 hole, and 54 hole golf course, including but not limited to a chip and putt golf course, driving range, golf practice or training golf facility or any other golf course that has at least two holes. Embodiments contemplate the multi-hole golfing facility can be a mobile structure, such as a cruise ship, or floating barge with the golf course installed over plastic, or wood or a similar non-soil material, which in embodiments could be a composite.

The term "non-permeable base" refers to a flexible polymer layer that is solid and supports the synthetic tufts.

The term "non-woven dual smooth surfaced geo-textile" refers to a permeable textile material used to increase soil stability, provide erosion control or aid in drainage. The non-woven dual smooth surfaced geo-textile allows water flow and water filtration while simultaneously excluding sand from entering the drain assembly. The non-woven dual smooth surfaced geo-textile 80 provides cross-plane filtering with an apparent opening size (AOS) of at least about 0.212 and a thickness greater than about 1.0 mm at 2 kPa normal load and with an approximate mesh opening of #70 US Sieve. The non-woven dual smooth surfaced geo-textile includes high-modulus polymeric filaments comprising monofilaments or multifilament.

The term "one piece synthetic turfed surface" refers to a surface of synthetic fibers made to look like natural grass and includes a non-permeable base, such as a base of polypropylene from which the synthetic tufted fibers protrude from. The synthetic fibers generally protrude in a range from % inch to 1 inch and wherein the tufts are spaced from $5/16^{th}$ inch to ⅜ inches apart. The non-permeable base is a flexible bendable but non-deforming non-breaking material which remains intact at temperatures from 6 degrees Fahrenheit to 125 degrees Fahrenheit.

The term "overlapping polymer mesh" refers to a continuous, and integral non-woven polymer mesh, such as a mesh made from polyvinyl chloride. The mesh is a single layer or a dual layer construction. In embodiments, the two layer overlapping polymer mesh is a dual layer mesh material each layer having pores. The first layer of the dual layer mesh material can be oriented in a first direction and a second layer of the dual layer mesh material can be positioned directly over and flush with the first layer and oriented in a second direction that is 90 degrees to the first orientation. The continuous integral edge refers to overlapping polymer mesh has a sod side, a middle section, and a sand side. In embodiments, the continuous integral edge overlapping polymer mesh 70 has holes only large enough to accommodate grass root penetration from sod to create an anchor between the sod and the synthetic tufted surface.

The term "pin" refers to a stick with a flag that is removable, inserted in a cup to provide a target to a golfer at a tee while the golfer is striking a golf ball at the tee or from a fairway sod or from a rough sod or a water permeable and water shuttling sand bunkers.

The term "real time indicator" refers to the instantaneously visual information obtained by golf course maintenance crews by camera, or by other surveillance that sand levels over the one piece synthetic tufted surface in the sand bunker are nearing a thickness of 1 inch or less.

The term "rough sod" refers to areas on a golf course outside of the fairway sods that generally feature higher, thicker grass with a height from 1 inch to 3 inches or naturally growing (unmaintained such as, not mowed) vegetation. Each rough sod contains sod.

The term "sand layer" refers to the playing surface within the perimeter of the water permeable and water shuttling sand bunker which has a depth that ranges from 2 to 4 inches and is 100% sand.

The term "segmented tufted synthetic strips" refers to small sections of the synthetic tufted surface which have been adhered together to form the one piece synthetic tufted surface.

The term "sod" as used herein refers to an earth bound grass system or a synthetic sod with fasteners, such as staples for connecting the synthetic sod to a surface.

The term "synthetic tufts" refers to grass like fibers extending from the non-permeable base. In embodiments all synthetic tufts extend in various direction away from the same side of the non-permeable base.

The term "tee" refers to the assembly at a specific location on the multi hole golfing facility where a golfer stands to strike a golf ball at the start of golf play for a given hole, and can include, sod, a device for supporting the golf ball for hitting at various heights. The sod is short cut, such as having a height under 4 inch.

The term "water permeable and water shuttling sand bunker" refers to shallow pits filled with sand and generally incorporating a raised lip which is referred to herein as "a continuous bunker edge".

The term "water removal" refers to flowing of water from a sand bunker into a drainage pipe. Water removal would be continuous during a rain storm.

Now turning to the Figures, FIG. 1 depicts an accelerated water removal low maintenance multi-hole golfing facility 10 having sand bunkers built with the kit.

The accelerated water removal low maintenance multi-hole golfing facility 10 has a plurality of golf holes 20*a*-20*e*.

Each golf hole 20*a*-20*e* has a tee. Tees 22*a*-22*o* are shown. Tees have sod 25*a*-25*o* (shown in other Figures) for providing a location for striking a golf ball.

Each golf hole has a green sod 24*a*-24*e* for receiving a golf ball. The green sod has a cup 26*a*-26*e* positioned in the green sod 24-*a*-24*e*. The cup is configured to hold a pin 27 with a flag 29 (shown in FIG. 6) for receiving a golf ball.

In embodiments, each golf hole 20*a*-20*e* can have fairway sod. Three golf holes are shown having sod 28*a*-28*c*. Fairway sod is generally positioned between a tee and a green.

Some golf holes 20*a*-20*e* have rough sod 30*a*-30*e*. Rough sod is positioned adjacent to at least one of: the tee, the green sod, and the fairway sod.

The accelerated water removal low maintenance multi-hole golfing facility 10 can have a clubhouse 110.

The multi hole golfing facility 10 has a plurality of water permeable and water shuttling sand bunkers 40*a*-40*g*.

Each water permeable and water shuttling sand bunker 40*a*-40*g* can positioned either: adjacent at least one of: the tee, the green, the fairway sod, and the rough sod.

The accelerated water removal low maintenance multi-hole golfing facility 10 is configured wherein the water flows from the continuous bunker edge over the one piece synthetic tufted surface through the non-woven dual smooth surfaced geo-textile to the drain assembly preventing contamination and clogging of the drain assembly while permitting a water flow rate from 6 inches to 24 inches of rain fall per hour forming a low maintenance water shuttling sand bunker for a multi-hole golfing facility.

Figure 2:
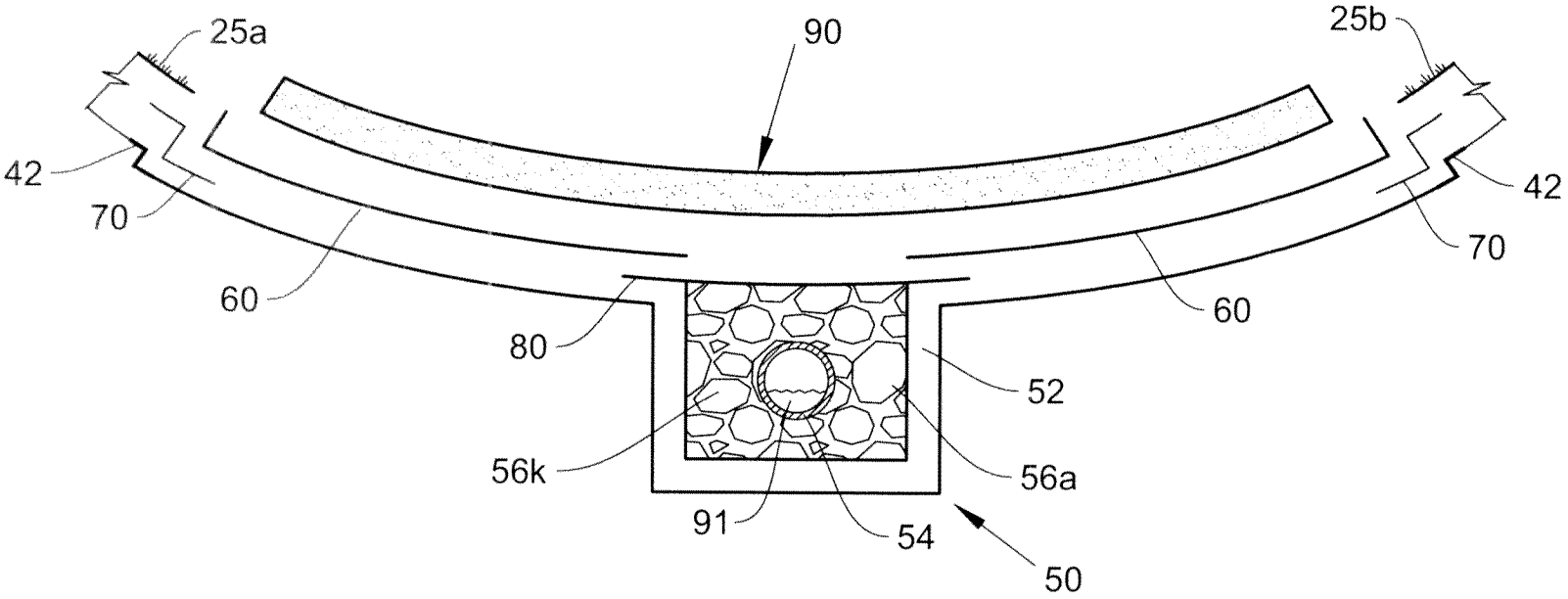
FIG. 2 depicts a section view of a detail of a water permeable and water shuttling sand bunker with drain assembly built with the kit according to one or more embodiments.

FIG. 2 depicts a section view of a detail of a water permeable and water shuttling sand bunker 40 with drain assembly according to one or more embodiments.

Each water permeable and water shuttling sand bunker has a continuous bunker edge 42 forming a perimeter of the water permeable and water shuttling sand bunker.

Each water permeable and water shuttling sand bunker has a drain assembly 50 positioned at a location to receive water falling on the water permeable and water shuttling sand bunker within the continuous bunker edge.

Each drain assembly 50 has a drainage trench 52.

A drainage pipe 54 is positioned in the drainage trench 52. The drainage pipe 54 fills from 30% and 40% of the drainage trench 52.

An aggregate material 56*a*-56*k* surrounds the drainage pipe 54 in the drainage trench 52.

This Figure shows a water permeable and water shuttling sand bunker having a one piece synthetic tufted surface 60 positioned to extend from the continuous bunker edge 42 towards the drain assembly 50 without covering the drain assembly 50.

Each water permeable and water shuttling sand bunker has an overlapping polymer mesh 70.

The water permeable and water shuttling sand bunker has a non-woven dual smooth surfaced geo-textile 80 cradling the drain assembly 50. The non-woven dual smooth surfaced geo-textile 80 is positioned under from 5% to 30% of the one piece synthetic tufted surface 60. The non-woven geo-textile is configured for allowing water flow and water filtration while simultaneously excluding sand from entering the drain assembly 50.

The non-woven dual smooth surfaced geo-textile 80 is positioned under from 5% to 30% of the one piece synthetic tufted surface 60 and in this Figure extends from 6 inches to 14 inches under the one piece synthetic tufted surface 60.

In embodiments, the non-woven dual smooth surfaced geo-textile is adhered to synthetic tufted surface with an adhesive.

The non-woven dual smooth surfaced geo-textile is from 3 ounce to 5 ounce weight geo-textile.

In embodiments, the non-woven dual smooth surfaced geo-textile 80 provides cross-plane filtering with an apparent opening size (AOS) at least about 0.212 and a thickness greater than about 1.0 mm at 2 kPa normal load; and with an approximate mesh opening of #70 US Sieve, the non-woven dual smooth surfaced geo-textile is formed by needle punching whereby the needle formed gaps in the geo-textile providing a greater than 1.7 cm/sec coefficient of permeability.

In embodiments, the non-woven dual smooth surfaced geo-textile 80 comprises high-modulus polymeric filaments comprising monofilaments or multifilament.

The non-woven dual smooth surfaced geo-textile 80 has a cross-plane water flow rate of greater than 4,885 liter/min/m.sup.2.

In embodiments, the non-woven dual smooth surfaced geo-textile 80 comprises at least 50% incompressible polypropylene (HDPP).

In embodiments, the non-woven dual smooth surfaced geo-textile 80 encapsulates the drain assembly, positioned under from 5% to 30% of the synthetic tufted surface 60, the non-woven dual smooth surfaced geo-textile configured for allowing water flow and water filtration while simultaneously excluding sand from entering the drain assembly 50 (shown in this FIG. 2).

The water permeable and water shuttling sand bunker 40 has a sand layer 90 simultaneously sufficiently thick to support a golfer and sufficiently porous to enable water removal at a flow rate of from 6 inches to 24 inches of rain fall per hour. The sand layer can have less than 2% fines. The sand layer is disposed over the one piece synthetic tufted surface within the continuous bunker edge. The sand layer and one piece synthetic tufted surface provide a real time indicator for maintenance by golf course maintenance crews.

The sand layer 90 is between 2 and 4 inches in thickness and can be uniformly over the one piece synthetic tufted surface.

In embodiments, the water permeable and water shuttling sand bunker has bowl shaped sides.

In embodiments, the sides of the shaped water permeable and water shuttling sand bunker slope from 10 degrees to 35 degrees.

In FIG. 2, sod 25*a* and 25*b* are shown positioned on sides of the water permeable and water shuttling sand bunker.

Water 91 is shown in the drainage pipe 54.

Figure 3:
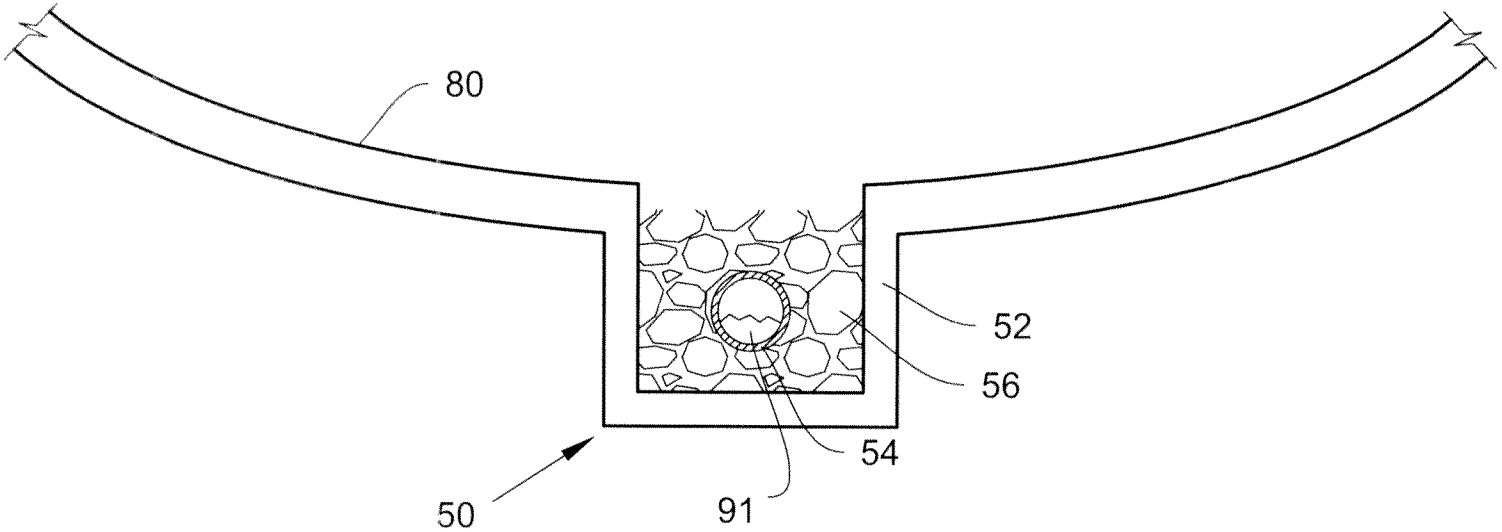
FIG. 3 depicts a cross section of the drain assembly using components of the kit according to one or more embodiments.

FIG. 3 depicts a cross section of the drain assembly 50 created using the kit according to one or more embodiments.

The drain assembly 50 has a drainage trench 52.

A drainage pipe 54 is installed in the drainage trench. The drainage pipe 54 fills from 30% and 40% of the drainage trench 52.

An aggregate material 56 is depicted surrounding the drainage pipe 54 in the drainage trench 52.

In embodiments, the drainage pipe 54 is perforated with sufficient holes that provide intake of water at a rate of 2% to 3% of the pipe volume per foot per minute and enabling out flows of from 16 gallons to 23 gallons per minute per foot.

A non-woven dual smooth surfaced geo-textile 80 is depicted.

Water 91 is shown in the drainage pipe 54.

Figure 4:
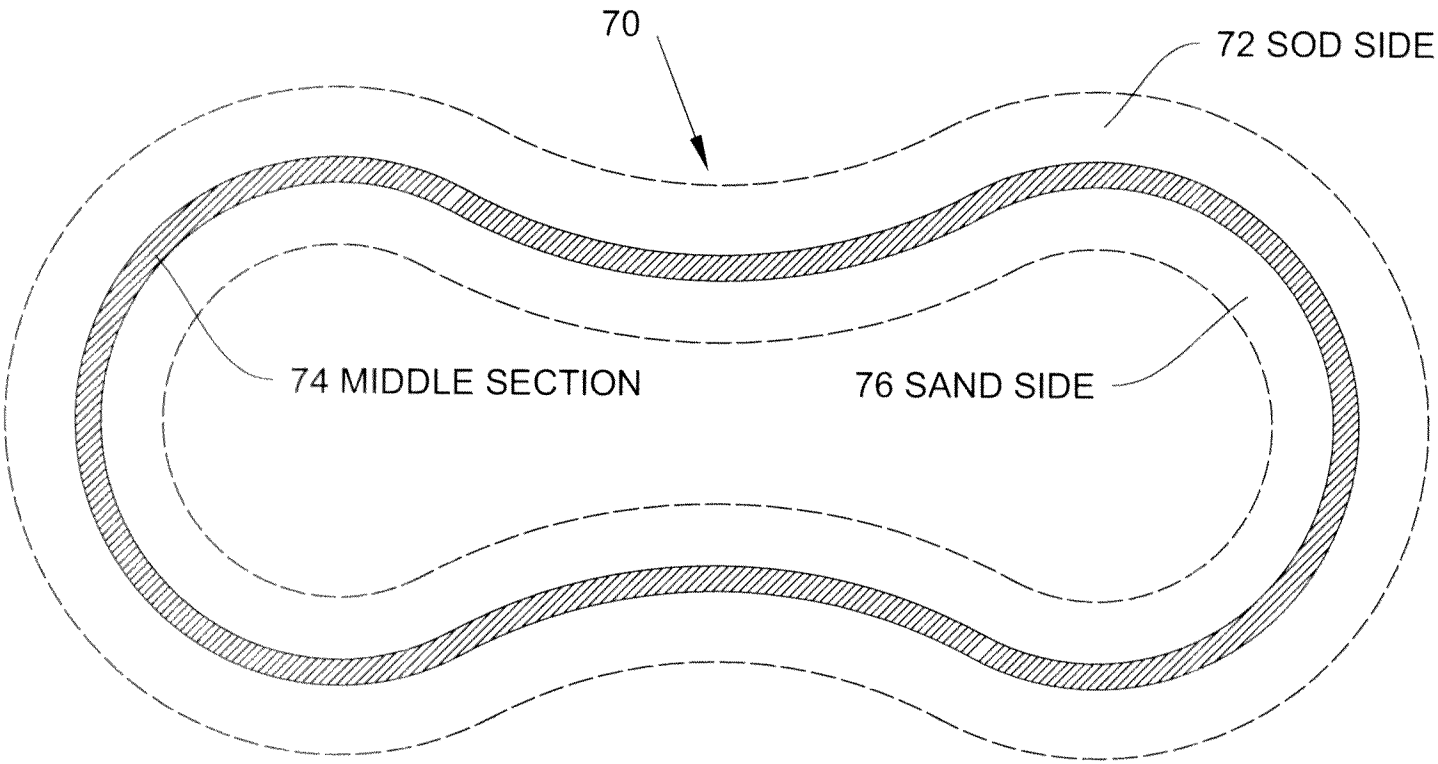
FIG. 4 depicts a top view of overlapping polymer mesh of the kit according to one or more embodiments.

FIG. 4 depicts a top view of overlapping polymer mesh 70 according to one or more embodiments.

The overlapping polymer mesh 70 has a sod side 72 mounted under the sod of a green, fairway sod or rough sod.

The overlapping polymer mesh 70 has a middle section 74 mounted over the continuous bunker edge integrally connected to the sod side.

The overlapping polymer mesh 70 has a sand side 76 which can be mounted under the synthetic tufted surface integrally connected to the middle section, In embodiments, the overlapping polymer mesh is a non-woven polyvinyl chloride mesh.

In embodiments, the sod side of the overlapping polymer mesh extends from 6 to 14 inches, such as 12 inches under the sod of at least one of: the tee, the fairway sod, the rough sod and the green.

The sand side of the overlapping polymer mesh extends from 6 inches to 14 inches, such as 12 inches under the one piece synthetic tufted surface.

The overlapping polymer mesh can have a density of 10 strands per inch forming a porosity large enough to allow grass roots of sod or fasteners of sod to penetrate the holes formed therein.

Figure 5:
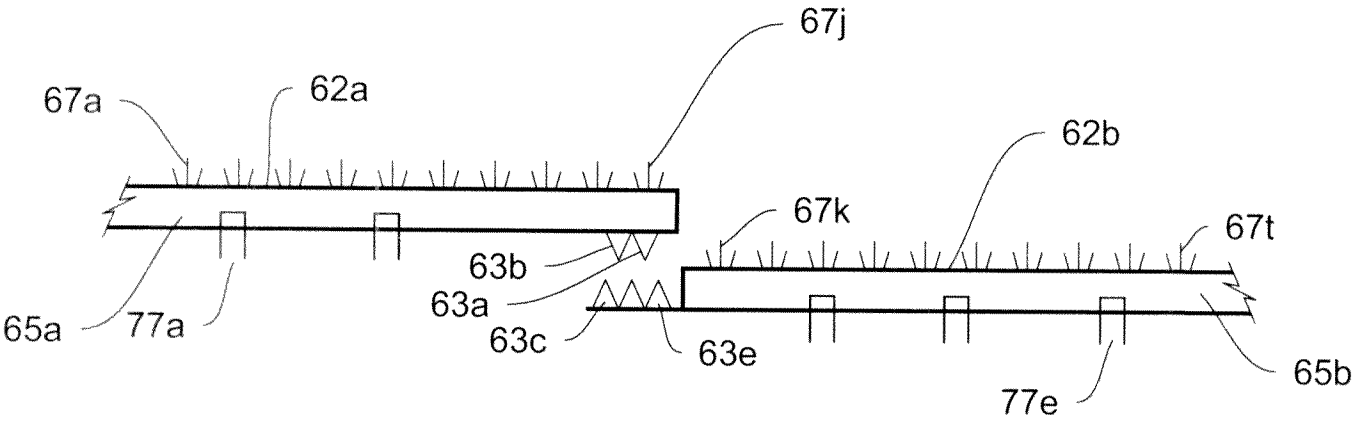
FIG. 5 depicts synthetic tufts on a plurality of non-permeable bases adhered together to form the one piece synthetic tufted surface of the kit according to embodiments.

FIG. 5 depicts synthetic tufts 67*a*-*t* on a plurality of non-permeable bases 65*a* and 65*b* adhered together to form the one piece synthetic tufted surface according to embodiments.

In this Figure, the one piece synthetic tufted surface is made from a plurality of segmented tufted synthetic strips 62*a*-62*b*.

Each segmented tufted synthetic strip has a length from 100 to 200 feet and a width from 8 feet to 12 feet, and wherein each of the plurality of segmented synthetic strips are adhered together with an adhesive shown as elements 63*a* through 63*e*.

The adhesive is a urethane based fast setting adhesive that sets within 2 to 4 hours.

In embodiments, the one piece synthetic tufted surface 60 covers 100% of the water permeable and water shuttling sand bunker from the continuous bunker edge towards the drain assembly 50.

The one piece synthetic tufted surface has a non-permeable base 65*a*-65*b* and a plurality of synthetic tufts 67*a*-67*t* protruding from the non-permeable base, wherein, the synthetic tufts have multiple fibers protruding from the non-permeable base at a height from ¾ inch to 1 inch and wherein the synthetic tufts are spaced from each other from $5/16^{th}$ inch to ⅜ inches and the non-permeable base comprises a flexible bendable non-deforming non-breaking material at temperatures from 6 degrees Fahrenheit to 125 degrees Fahrenheit.

In embodiments, the overlapping polymer mesh has holes sufficient to accommodate grass root penetration from sod and fastener 77*a*-77*e* forming an anchor.

Figure 6:
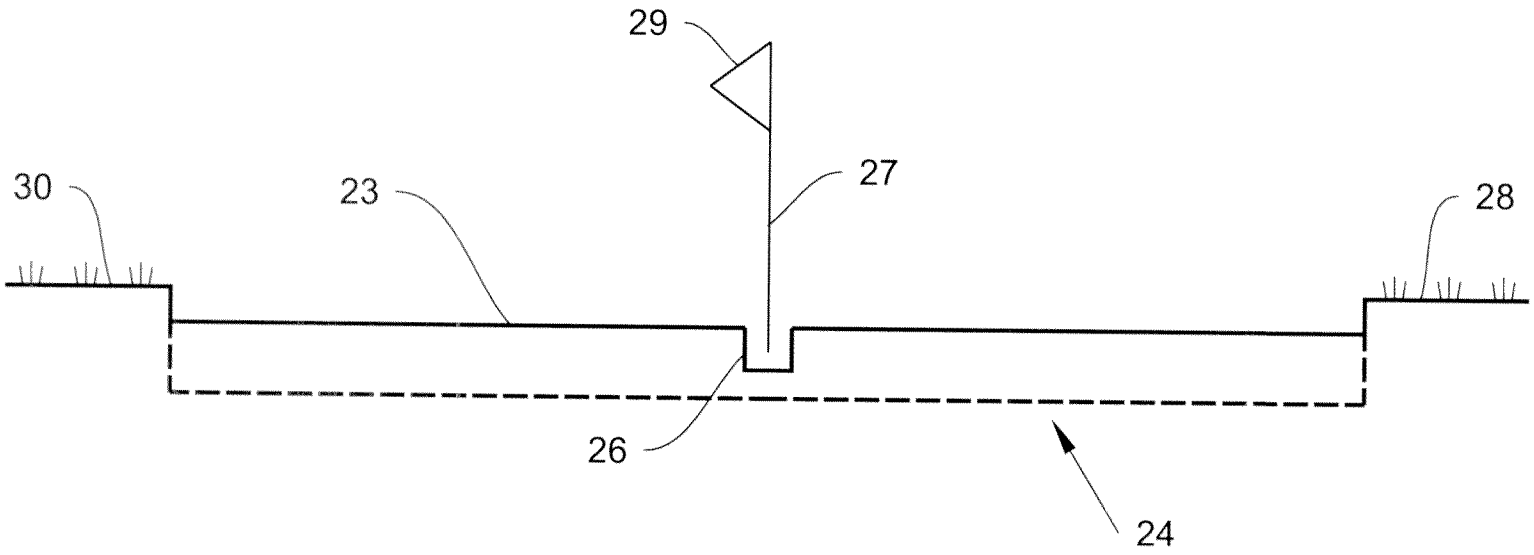
FIG. 6 is cross section of a green for receiving a golf ball with greens sod, a cup, a pin with a flag associated with a sand bunker built by the kit according to embodiments.

FIG. 6 is cross section of a green 24 for receiving a golf ball which can have a sand bunker created by the kit adjacent or proximate to it.

Green 24 has green sod 23, and a cup 26. The cup holds a pin 27 with a flag 29. The cup is positioned in the green for receiving a golf ball.

Fairway sod 28 is shown adjacent the green 24.

Rough sod 30 is shown adjacent the green 24.

Figure 7:
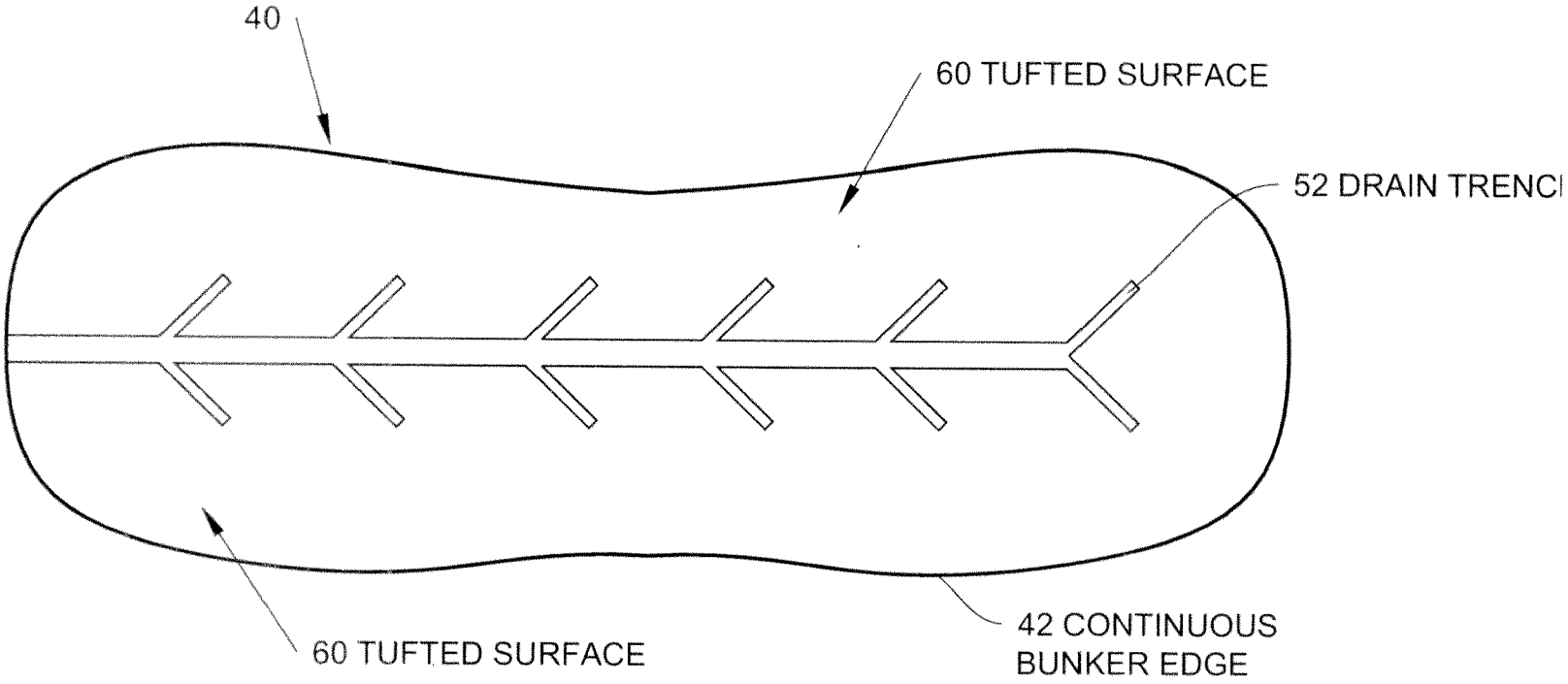
FIG. 7 is a top view of a water permeable and water shuttling sand bunker with one piece synthetic tufted surface with drainage assembly built using components of the kit according to embodiments.

FIG. 7 is a top view of a water permeable and water shuttling sand bunker 60 with one piece synthetic tufted surface 60 and the drainage trench 52 according to embodiments.

The water permeable and water shuttling sand bunker 40 is shown from a top view with the continuous bunker edge 42 forming a perimeter of the water permeable and water shuttling sand bunker.

From this top view, a drain trench 52 can be seen positioned at a location to receive water falling on the water permeable and water shuttling sand bunker within the continuous bunker edge. The drainage trench 52 is shown extending longitudinally through the sand bunker.

The one piece synthetic tufted surface 60 is also depicted not covering the drainage trench.

Figure 8:
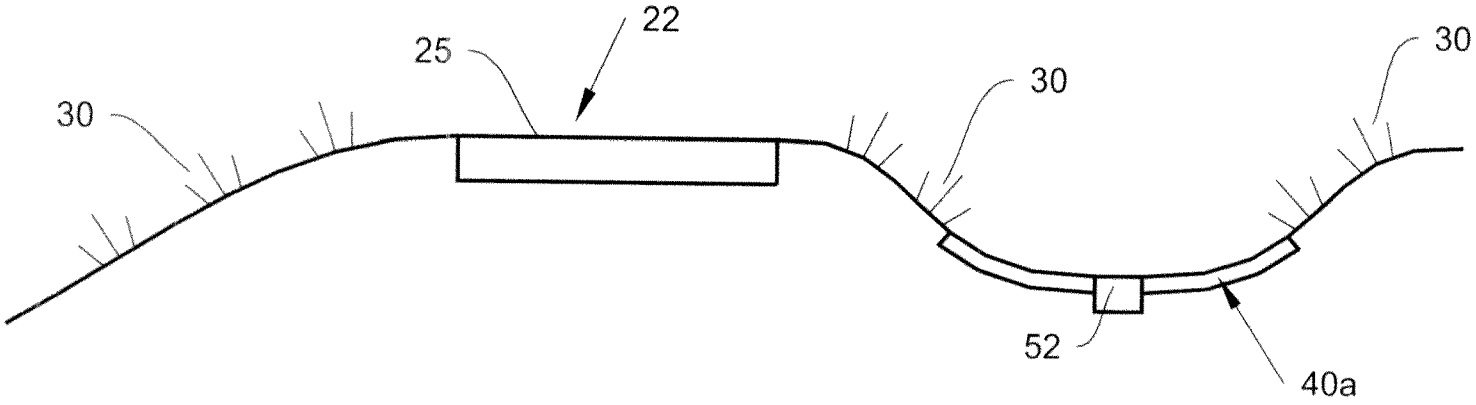
FIG. 8 is a cross section of a tee with sod proximate a water permeable and water shuttling sand bunker built with components of the kit.

FIG. 8 a cross section of a tee 22 with sod 25 proximate a water permeable and water shuttling sand bunker 40 created using the kit.

Rough sod 30 is shown in this Figure along with the drainage trench 52.

As an example, an accelerated water removal low maintenance multi-hole golfing facility can have 9 golf holes for play.

The first golf hole is a par 4, and has a tee with sod, providing a location for striking a golf ball and rough sod. This first golf hold has fairway sod, more rough sod, and a green. Next to the green is a water permeable and water shuttling sand bunkers.

The second golf hole is a par 3. This second hole has a tee with sod, providing a location for striking a golf ball and rough sod. This second golf hole has no fairway sod, more rough sod, and a green. Next to the green is a water permeable and water shuttling sand bunker.

The third golf hole is a par 5. This third hole has a tee with sod, providing a location for striking a golf ball and rough sod. This third golf hole has fairway sod and a water permeable and water shuttling sand bunker next to the fairway sod. This third hole has a green with rough sod next to the green.

The fourth golf hole is a par 4. This fourth hole has a tee with sod, providing a location for striking a golf ball and rough sod. A water permeable and water shuttling sand bunker is positioned next to the tee. This hole has fairway sod, a green and rough sod next to the green.

The fifth golf hole is a par 4. This fifth hole has a tee with sod, providing a location for striking a golf ball and rough sod. This fifth golf hole has fairway sod and two water permeable and water shuttling sand bunker positioned on either side of the fairway sod. This fifth hole has a green with rough sod next to the green.

The sixth golf hole is a par 4. This sixth hole has a tee with sod, providing a location for striking a golf ball and rough sod. This sixth golf hole has fairway sod and a green. A water permeable and water shuttling sand bunker is positioned next to the green with rough sod also next to the green.

The seventh golf hole is a par 3. This seventh hole has a tee with sod, providing a location for striking a golf ball and rough sod. Two water permeable and water shuttling sand bunker are used, one is next to the tee, and one is next to the green. No fairway sod is used for this hole. This seventh hole has a green with additional rough sod next to the green.

The eighth golf hole is a par 4. This 8th hole has a tee with sod, providing a location for striking a golf ball and rough sod. This $8^{th}$ golf hole has fairway sod and no water permeable and water shuttling sand bunker. This 8th hole has a green with rough sod next to the green.

The last and 9th golf hole is a par 5. This 9th hole has a tee with sod, providing a location for striking a golf ball and rough sod. This 9th golf hole has fairway sod and a water permeable and water shuttling sand bunker next to the fairway sod. This $9^{th}$ hole has a green with rough sod next to the green.

When it rains, this multi-hole golfing facility has rain water flowing onto the water permeable and water shuttling sand bunkers. Water flows from each water permeable and water shuttling sand bunker's continuous bunker edge over the one piece synthetic tufted surface through the non-woven dual smooth surfaced geo-textile to the drain assembly. Water is filtered by the assembly preventing contamination and clogging of the drain assembly while permitting a water flow rate from 6 inches to 24 inches of rain fall per hour away from the drain assembly. The water permeable and water shutting and bunkers form a low maintenance a multi-hole golfing facility which has a visual indicator when the sand bunker needs additional sand.

In this example, each of the water permeable and water shuttling sand bunkers, each water permeable and water shuttling sand bunker is positioned either adjacent at least one of: the tee, the green, the fairway sod, and the rough sod.

In this specific example, each water permeable and water shuttling sand bunker has a continuous bunker edge forming a perimeter of the water permeable and water shuttling sand bunker. In the first two holes, the perimeter is 40 feet. Golf hole 3 and 4 have a continuous bunker edge 300 feet long. Golf holes 5 and 6 each have a continuous bunker edge 100 and 250 feet long, respectively. Golf hole 7 has a continuous bunker edge that is 650 feet long and another that is 225 feet long. Golf hole 9 has continuous bunker edge that is 125 feet long.

Each of the water permeable and water shuttling sand bunkers has a drain assembly 50 positioned at a location to receive water falling on the water permeable and water shuttling sand bunker within the continuous bunker edge.

For golf holes, the drainage trench varies in size based on the perimeter of the holes. For golf hole 1 the drainage trench is 6 feet long. For golf hole 2 the drainage trench is 6 feet long. For golf hole 3 the drainage trench is 45 feet long. For golf hole 4 the drainage trench is 45 feet long. For golf hole 5 the drainage trench is 15 feet long. For golf hole 6 the drainage trench is 30 feet long. For golf hole 7 the drainage trench is 98 feet and 34 feet long respectively. For golf hole 9, the drainage trench is 19 feet long.

A drainage pipe 54 fills each drainage trench.

Each drainage pipe fills from 30% and 40% of the drainage trench which means, each drainage pipe varies in outer diameter.

For golf hole 1 the drainage pipe has an outer diameter of 4 inches. For golf hole 2 the drainage pipe has an outer diameter of 4 inches. For golf hole 3 the drainage pipe has an outer diameter of 6 inches. For golf hole 4 the drainage pipe has an outer diameter of 6 inches. For golf hole 5 the drainage pipe has an outer diameter of 4 inches. For golf hole 6 drainage pipe has an outer diameter of 4 inches. For golf hole 7 the drainage pipe for both has an outer diameter of 6 inches. For golf hole 9, the drainage pipe has an outer diameter of 4 inches.

For each of the golf holes the aggregate material surrounding each drainage pipe in each drainage trench can be the same material. The aggregate material can change in volume.

For all the golf holes, the aggregate material volume is from 60 to 70% the volume of the drainage trench.

For each golf hole, a one piece synthetic tufted surface 60 positioned to extend from the continuous bunker edge 42 towards the drain assembly 50 without covering the drain assembly. However, the surface area of the one piece synthetic tufted surface changes for each water permeable and water shuttling sand bunker.

For golf hole 1, the surface area of the one piece synthetic tufted surface can be 100 square feet.

For golf hole 2, the surface area of the one piece synthetic tufted surface can be 100 square feet.

For golf hole 3, the surface area of the one piece synthetic tufted surface can be 5625 square feet.

For golf hole 4, the surface area of the one piece synthetic tufted surface can be can be 5625 square feet.

For golf hole 5, the surface area of the one piece synthetic tufted surface can be 625 square feet.

For golf hole 6, the surface area of the one piece synthetic tufted surface can be 625 square feet.

For golf hole 7, the surface area of the one piece synthetic tufted surface can be 26,406 square feet and 4064 square feet respectively.

For golf hole 9, the surface area of the one piece synthetic tufted surface can be 976 square feet.

For each golf hole, the overlapping polymer mesh provides a one piece mesh wherein the sod side and the middle section are in a 1:1 ratio and the middle section and the sand side are in a 1:1 ratio. In embodiments, the sod side and the middle section can be in a ratio of 0.5:1.5 to 2 and the middle section to the sand side are in a ratio of 2-1.5:0.5. In embodiments, the overlapping polymer mesh is a one layer mesh.

In three of the holes, the middle section can be 4 inches in width with the sand side and the sod side each being 7 inches in width.

Fasteners can be used, one every square foot for each of the sand bunkers to hold the synthetic tufted surface to the overlapping polymer mesh, the non-woven dual smooth surfaced geotextile and native soil forming a plurality of anchors.

For each sand bunker one layer of non-woven dual smooth surfaced geo-textile cradles the drain assembly. For golf holes 1 and 2, the non-woven dual smooth surfaced geo-textile is positioned under 6% of the synthetic tufted surface.

For golf hole 3 and 4, the non-woven dual smooth surfaced geo-textile is positioned under 8% of the synthetic tufted surface.

For golf hole 5, the non-woven dual smooth surfaced geo-textile is positioned under 17% of the synthetic tufted surface.

For golf hole 6, the non-woven dual smooth surfaced geo-textile is positioned under 30% of the synthetic tufted surface.

For golf hole 7, the non-woven dual smooth surfaced geo-textile is positioned under 20% of the synthetic tufted surface.

For golf hole 9, the non-woven dual smooth surfaced geo-textile is positioned under 21% of the synthetic tufted surface For each hole, the non-woven geo-textile is configured for allowing water flow and water filtration while simultaneously excluding sand from entering the drain assembly.

Each water permeable and water shuttling sand bunker of each hole has a sand layer 90.

Each water permeable and water shuttling sand bunker's sand layer is simultaneously sufficiently thick to support a golfer and sufficiently porous to enable water removal at a flow rate of from 6 to 24 inches of rain fall per hour, the sand layer comprising less than 2% fines, disposed over the one piece synthetic tufted surface within the continuous bunker edge.

For each water permeable and water shuttling sand bunker, the bottom of the bunker is 4 inches thick and then the sand layer tapers to 2 inches as the sand layer approaches the continuous bunker edge.

In all the bunkers, the sand layer and one piece synthetic tufted surface provide a real time indicator for maintenance by golf course maintenance crews.

While these embodiments have been described with emphasis on the embodiments, it should be understood that within the scope of the appended claims, the embodiments might be practiced other than as specifically described herein.

What is claimed is:

1. A kit for building water permeable and water shuttling sand bunkers comprising:

a. a drainage pipe that fills from 30% and 40% of a drainage trench;

b. a one piece synthetic tufted surface;

c. an overlapping polymer mesh comprising:

(a) a sod side mounted under the sod of a green, fairway sod or rough sod;

(b) a middle section mounted over a continuous bunker edge integrally connected to the sod side; and (c) a sand side mounted under the one piece synthetic tufted surface integrally connected to the middle section, the overlapping polymer mesh comprising holes sufficient to accommodate grass root penetration from sod;

d. a non-woven dual smooth surfaced geo-textile cradling a drain assembly, positioned under from 5% to 30% of the synthetic tufted surface, the non-woven geo-textile configured for allowing water flow and water filtration while simultaneously excluding sand from entering the drain assembly; and e. a plurality of fasteners for connecting the overlapping polymer mesh to the one piece synthetic tufted surface, non-woven dual smooth surfaced geo-textile and native soil;

wherein the kit creates a sand bunker with the non-woven dual smooth surfaced geotextile installed in a drainage trench of a sand bunker, the drainage pipe to be installed in the drainage trench over the non-woven dual smooth surfaced geotextile and surrounded with aggregate, the overlapping polymer mesh is installed over a continuous bunker edge; one piece synthetic tufted surface is positioned to extend from the continuous bunker edge towards the drain assembly without covering the drain assembly, the plurality of fasteners connect the overlapping polymer mesh to the one piece synthetic tufted surface, non-woven dual smooth surfaced geo-textile to native soil forming an anchor; creating a sand layer over the one piece synthetic turfted surface that is simultaneously sufficiently thick to support a golfer and sufficiently porous to enable water removal at a flow rate of from 6 to 24 inches of rain fall per hour; and wherein the water flows from the continuous bunker edge over the one piece synthetic tufted surface through the non-woven dual smooth surfaced geo-textile to the drain assembly preventing contamination and clogging of the drain assembly while permitting a water flow rate from 6 inches to 24 inches of rain fall per hour forming a low maintenance water shuttling sand bunker for a multi-hole golfing facility.

2. The kit of claim 1, wherein the water permeable and water shuttling sand bunker comprises bowl shaped sides.

3. The kit of claim 2, wherein the sides of the shaped water permeable and water shuttling sand bunker slope from 10 degrees to 35 degrees.

4. The kit of claim 1, wherein the overlapping polymer mesh is a non-woven polyvinyl chloride mesh.

5. The kit of claim 1, wherein the sod side of the overlapping polymer mesh is sized to extend from 6 to 14 inches under the sod of at least one of: the tee, the fairway sod, the rough sod and the green.

6. The kit of claim 1, wherein the sand side of the overlapping polymer mesh extends from 6 to 14 inches under the one piece synthetic tufted surface.

7. The kit of claim 1, wherein the overlapping polymer mesh comprises 10 strands per inch forming a porosity large enough to allow grass roots of sod or fasteners of sod to penetrate the holes formed therein.

8. The kit of claim 1, wherein the one piece synthetic tufted surface comprises: a plurality of segmented tufted synthetic strips, each segmented tufted synthetic strip having a length from 100 to 200 feet and a width from 8 feet to 12 feet, and wherein each of the plurality of segmented synthetic strips are adhered together with an adhesive.

9. The kit of claim 1, wherein the one piece synthetic tufted surface is sized to cover 100% of the water permeable and water shuttling sand bunker from the continuous bunker edge towards the drain assembly.

10. The kit of claim 8, wherein the adhesive is a urethane based fast setting adhesive that sets within 2 to 4 hours.

11. The kit of claim 1, wherein the non-woven dual smooth surfaced geo-textile is sized to be positioned under from 5% to 30% of the synthetic tufted surface extends from 6 to 14 inches under the synthetic tufted surface.

12. The kit of claim 1, wherein the non-woven dual smooth surfaced geo-textile is adhered to synthetic tufted surface with an adhesive.

13. The kit of claim 1, wherein the non-woven dual smooth surfaced geo-textile is from 3 ounce to 5 ounce weight geo-textile.

14. The kit of claim 1, wherein the non-woven dual smooth surfaced geo-textile provides cross-plane filtering with an apparent opening size (AOS) at least about 0.212 mm and a thickness greater than about 1.0 mm at 2 kPa normal load; and with an approximate mesh opening of #70 US Sieve, the non-woven dual smooth surfaced geo-textile is formed by needle punching whereby the needle formed gaps in the geo-textile providing a greater than 1.7 cm/sec coefficient of permeability.

15. The kit of claim 1, wherein the non-woven dual smooth surfaced geo-textile comprises high-modulus polymeric filaments comprising monofilaments or multifilament.

16. The kit of claim 1, wherein the non-woven dual smooth surfaced geo-textile has a cross-plane water flow rate of greater than 4,885 liter/min/m.sup.2.

17. The kit of claim 1, wherein the non-woven dual smooth surfaced geo-textile comprises at least 50% incompressible polypropylene (HDPP).

18. The kit of claim 1, wherein the sand layer is between 2 and 4 inches in thickness uniformly over the one piece synthetic tufted surface.

19. The kit of claim 1, wherein the drainage pipe is perforated with sufficient holes that provide intake of water at a rate of 2% to 3% of the pipe volume per foot per minute and enabling out flows of from 16 gallons to 23 gallons per minute per foot.

20. The kit of claim 1, wherein the one piece synthetic tufted surface comprises a non-permeable base and a plurality of synthetic tufts protruding from the non-permeable base, wherein the synthetic tufts have multiple fibers protruding from the non-permeable base at a height from ¾ inch to 1 inch and wherein the synthetic tufts are spaced from each other from $5/16^{th}$ inch to ⅜ inches and the non-permeable base comprises a flexible bendable non-deforming non-breaking material at temperatures from 6 degrees Fahrenheit to 125 degrees Fahrenheit.

21. The kit of claim 1, wherein the non-woven dual smooth surfaced geo-textile 80 encapsulates the drain assembly, positioned under from 5% to 30% of the synthetic tufted surface, the non-woven geo-textile configured for allowing water flow and water filtration while simultaneously excluding sand from entering the drain assembly.

* * * * *